US006758178B2

(12) United States Patent
Takahashi et al.

(10) Patent No.: US 6,758,178 B2
(45) Date of Patent: Jul. 6, 2004

(54) VALVE TIMING CONTROL DEVICE

(75) Inventors: Kinya Takahashi, Obu (JP); Koji Kuroda, Nagoya (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 10/097,836

(22) Filed: Mar. 15, 2002

(65) Prior Publication Data

US 2002/0139330 A1 Oct. 3, 2002

(30) Foreign Application Priority Data

Mar. 30, 2001 (JP) ..... 2001-099674

(51) Int. Cl.[7] ..... F01L 1/34

(52) U.S. Cl. ..... 123/90.17; 123/90.15; 74/568 R

(58) Field of Search ..... 123/90.15, 90.17, 123/90.12; 92/122, 120, 130 R, 135, 121; 74/568 R; 464/1, 2, 160

(56) References Cited

U.S. PATENT DOCUMENTS 5,836,277 A * 11/1998 Kira et al. ..... 123/90.17
6,039,016 A 3/2000 Noguchi
6,155,219 A 12/2000 Fukuhara et al.
6,276,321 B1 * 8/2001 Lichti et al. ..... 123/90.17

FOREIGN PATENT DOCUMENTS

| | | |
|---|---|---|
| JP | A-10-252420 | 9/1998 |
| JP | 11-223113 | 8/1999 |
| JP | A-11-294121 | 10/1999 |
| JP | A-2000-161027 | 6/2000 |

* cited by examiner

*Primary Examiner*—Thomas Denion
*Assistant Examiner*—Jaime Corrigan
(74) *Attorney, Agent, or Firm*—Nixon & Vanderhye PC

(57) ABSTRACT

A valve timing control device for adjusting the timing of opening a valve of an internal combustion engine includes a torsion spring having one end engaged with a shoe housing and the other end engaged with a vane rotor to urge the vane rotor, relative to the shoe housing, toward the advancing side or the delaying side. The end of the torsion spring engaged with the vane rotor is rotatable together with the vane rotor and inwardly directed in the radial direction, referencing the torsion spring. The vane rotor has a hook groove with which the inwardly-directed end of the torsion spring is engaged. Thus, a driven member having the vane rotor can be made smaller. Also, there is no need to form the hook groove inside the vane, so vane strength is not compromised and sealing with the vane is attained.

7 Claims, 6 Drawing Sheets

VALVE TIMING CONTROL DEVICE

CROSS REFERENCE TO RELATED APPLICATION

This application is based on, and incorporates herein by reference, Japanese Patent Application No. 2001-99674 filed on Mar. 30, 2001.

BACKGROUND OF THE INVENTION

1. Field of the Invention

The present invention relates to a valve timing control device for adjusting the timing in opening an intake valve or an exhaust valve of an internal combustion engine. More specifically, the invention relates to a vane-type valve timing control device having a torsion spring for applying a rotational load between a shoe housing and a vane rotor.

2. Description of Related Art

In general, a vane-type valve timing control device comprising the following configuration is known in the art. That is, such a device comprises a shoe housing rotatably arranged with a crank shaft (corresponding to a drive shaft) and a vane rotor rotatably arranged with a cam shaft (corresponding to a driven shaft) for rotating the vane rotor relative to the shoe housing. Also, the vane rotor has a plurality of vanes which are provided with the cam shaft and which extend outwardly from the vane rotor in the radial direction into chambers formed in the shoe housing. The vanes divide each chamber into advancing chambers and delaying chambers. The vane rotor can be hydraulically rotated within the shoe housing between the advancing chamber and the delaying chamber causing the cam shaft to shift to the advancing side or the delaying side.

When the engine is running, the cam shaft can be driven to the advancing side by sequentially transmitting torque to the shoe housing, the vane rotor, and the cam shaft. In other words, the vane rotor receives a load in the advancing direction. Therefore, when the vane rotor rotates to the advancing side or the delaying side, the response of the relative rotation to the advancing side can be decreased compared with the relative rotation to the delaying side.

If the valve timing control device is mounted on the cam shaft on the exhaust side, the duration of simultaneously opening the inlet valve and the exhaust valve becomes longer than required when the exhaust side cam shaft is located at the delaying position together with the inlet side cam shaft when the engine is started. Consequently, there are problems during startup.

For solving such a disadvantage, other conventional valve timing control devices have been disclosed. Unexamined Japanese Patent Publication (Kokai) Nos. Hei 11-294121 (1999), 10–252420 (1998), and 11-132014 (1999) disclose such devices. In each of these publications, there is disclosed technical means of engaging the ends of a torsion spring with a shoe housing (or a member rotatable together with the shoe housing) and a vane rotor, respectively, to urge the vane rotor relative to the shoe housing in an advancing direction.

In the conventional valve timing control device disclosed in each of those publications, both ends of the torsion spring are directed in the axial direction of the torsion spring. The vane rotor has an axial opening for engaging an axial end of the torsion spring. In this case, however, the formation of such an axial opening requires an increase in the axial thickness (cross-section) of the vane rotor, and limits any reduction in physical size of the valve timing control device with, say, a vane rotor with a smaller cross-section.

As shown in FIG. 9, for example, there is shown one end J3 of the torsion spring J2 to be engaged with the vane rotor J1. The end J3 is formed to extend outwardly in the radial direction of the torsion spring J2. A hook groove J4 for engaging the end J3 of the torsion spring J2 is formed in the vane rotor J1.

In this case, however, in FIG. 9, the hook groove J4 is formed in the vane J5 when the hook groove J4 is extended outward in the radial direction of the torsion spring J2. As a result, problems such as a decrease in the strength of such a vane J5 are caused. In addition, the length of a seal with the vane J5 is shorter, so that the degree of sealing between the advancing chamber J6 and the delaying chamber J7, partitioned by the vane J5, can be decreased when the vane J5 is made smaller for advantageously making the overall size of the valve timing control device smaller.

On the other hand, if the vane rotor is displaced to the advancing side or the delaying side, there is a possibility that the position of the torsion spring may be changed because of the variation in spring load applied on the torsion spring. When the spring load changes, the coiled portion of the torsion spring becomes inclined, skewed, or eccentric from the axial center of the coiled portion because the torsion spring tries to keep its appropriate position for the changing load.

It is conceivable that the torsion spring will not generate predetermined torque when the coiled portion of the torsion spring becomes inclined or eccentric. Additionally, it is also possible that the torsion spring may make contact with another component and the component will inappropriately wear due to, say, vibrations or rubbing created by the coiled portion that is inclined or eccentric.

SUMMARY OF THE INVENTION

Accordingly, it is a first object of the present invention to provide an improved valve timing control device having a torsion spring: (A) for urging the vane rotor relative to the shoe housing toward the advancing side or the delaying side; (B) for preventing the vane rotor within the shoe housing from being overly large in cross-section, or thick; (C) for preventing a decrease in the strength of a vane placed between the advancing chamber and the delaying chamber; and (D) for preventing a decrease in the sealability of the advancing chamber and the delaying chamber with the vane by providing an engaging means for the torsion spring.

A second object of the present invention is to provide an improved valve timing control device having a torsion spring: (A) capable of preventing the inclination or eccentricity of a coiled portion of the torsion spring due to the variation in spring load applied to the torsion spring; (B) capable of generating a constant, predetermined amount of torque; and (C) capable of preventing wear on an unexpected part caused by loading on the torsion spring.

In a first embodiment of the present invention, a valve timing control device is mounted on a power transmission system for transferring power from a drive shaft of an internal combustion engine to a driven shaft for opening and closing a valve. The device causes a phase difference between the rotation of the drive shaft and the rotation of the driven shaft. Additionally, there is a shoe housing having a chamber, the shoe housing being rotatable together with one of the drive shaft and the driven shaft, a vane rotor being rotatable together with the other of the drive shaft and the driven shaft, the vane partitioning the chamber formed in the shoe housing into an advancing chamber and a delaying chamber. Furthermore, there is a torsion spring having one end engaged with the shoe housing or a member rotatable together with the shoe housing and the other end engaged with the vane rotor or a member rotatable together with the vane rotor to urge the vane rotor relative to the shoe housing toward an advancing side or a delaying side. The other end of the torsion spring engaged with the vane rotor or the member rotatable together with the vane rotor is provided as an inwardly-directed end which is inwardly directed in the radial direction of the torsion spring, and the vane rotor or the member rotatable together with the vane rotor has a hook groove with which the inwardly-directed end of the torsion spring is engaged.

The hook groove for engaging the torsion spring is formed to extend inwardly in the radial direction of the torsion spring. In other words, the hook groove is not formed in the inside of the vane for partitioning the advancing chamber and the delaying chamber. This makes it possible to prevent compromising the strength of the vane while decreasing the size of the vane rotor. Additionally, the hook groove is formed as described above, so that the wearing away of the vane rotor in contact with the torsion spring can be prevented even though the vane rotor is made of a low hardness material such as aluminum or soft iron.

In the second aspect of the present invention, a valve timing control device can be operated without the torsion spring becoming out-of-balance. Inclination or eccentricity of a coiled portion of the torsion spring, with respect to a shaft center, will not occur even though the spring load applied on the torsion spring may vary as the vane rotor is displaced to the advancing or delaying side. This makes it possible to generate a predetermined amount of torque constantly by the torsion spring regardless of the variation in spring load applied on the torsion spring. Also, premature wearing of other parts by the torsion spring contacting with other parts will not occur.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

A valve timing control device in accordance with each of preferred embodiments of the present invention will be described with reference to the accompanying drawings. The following description of the preferred embodiments is merely exemplary in nature and is in no way intended to limit the invention, its application, or uses.

[First Embodiment]

Figure 1:
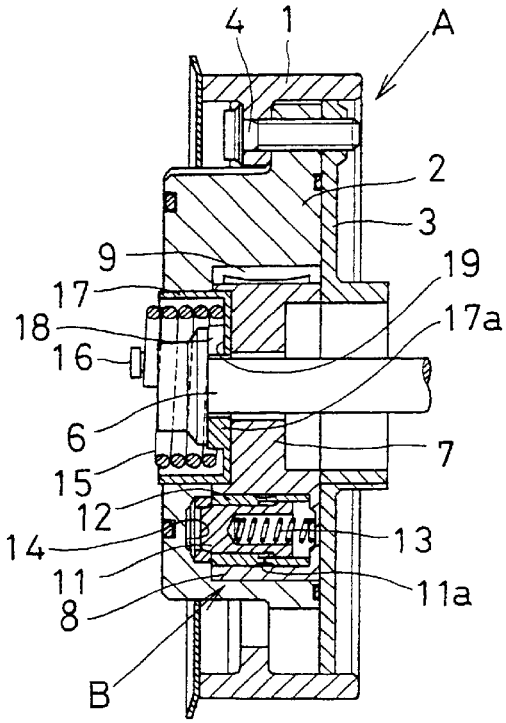
FIG. 1 is a cross-sectional view of a valve timing control device in a first embodiment of the present invention.
Figure 2:
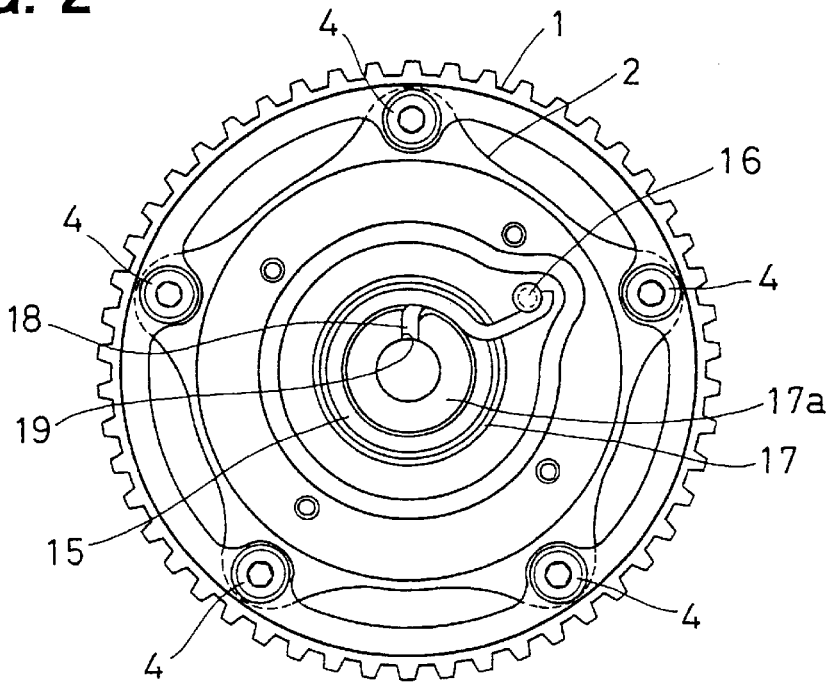
FIG. 2 is a front view of the valve timing control device of the first embodiment of the present invention.
Figure 3:
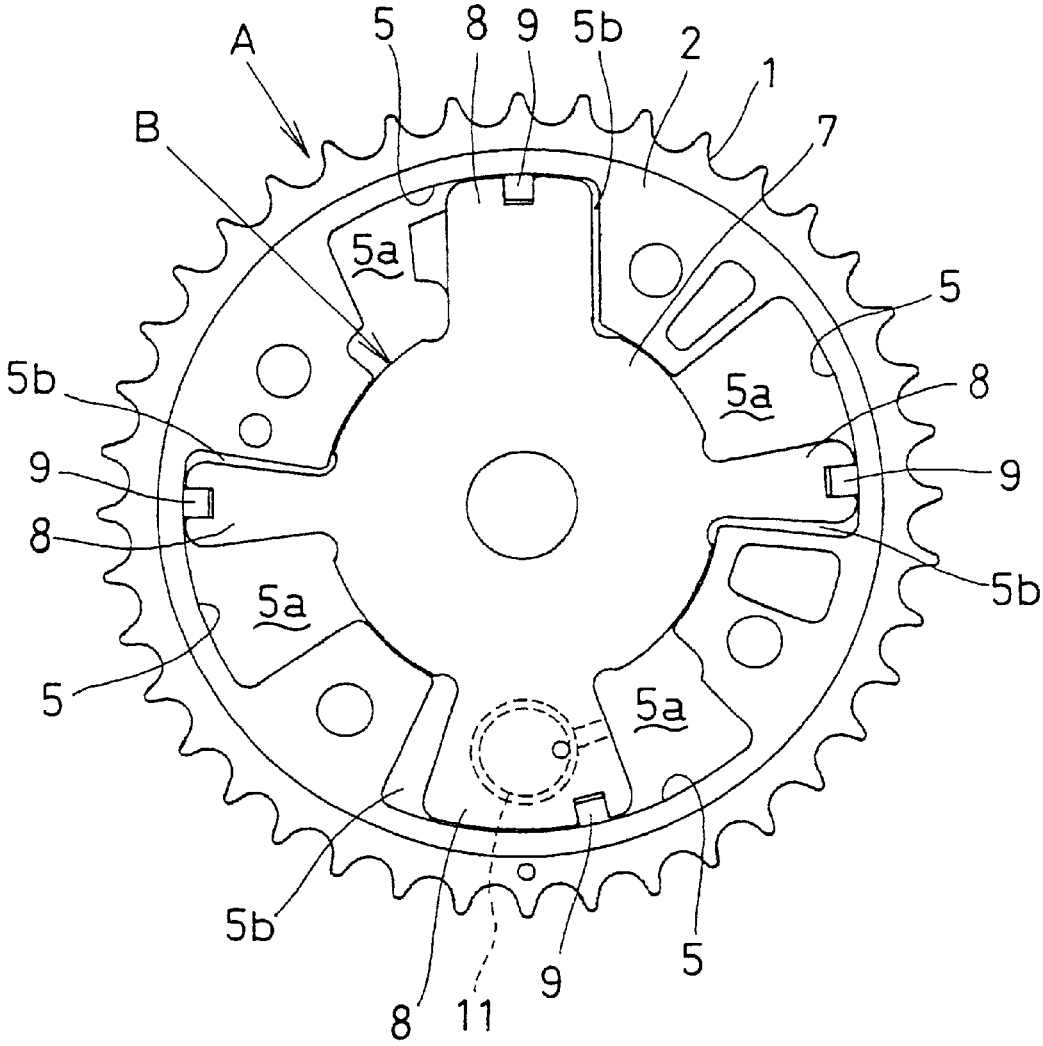
FIG. 3 is an explanatory diagram of an inner structure of a shoe housing.

A valve timing control device as a first embodiment of the present invention is shown in FIGS. 1 to 3. In these figures, FIG. 1 is a cross-sectional view taken along an axial direction of the valve timing control device for illustrating the internal configuration of the valve timing control device, FIG. 2 is a front view of the valve timing control device, and FIG. 3 is an explanatory diagram for illustrating the inner configuration of a shoe housing of the valve timing control device. The valve timing control device of the present embodiment may be mounted on a cam shaft on the exhaust side of a DOHC (double overhead camshaft) engine to be driven by the cam shaft independent of intake and exhaust valves. The valve timing control device is capable of changing the opening/closing timing of the exhaust valves in a successive or stepwise manner. In this embodiment, the following description will regard the left side of FIG. 1 as the front side of the valve timing control device and regard the right side of FIG. 1 as the rear side.

The valve timing control device comprises a drive member A and a driven member B. Drive member A can be driven by a crank shaft through a timing belt (or chain or the like) and driven member B can be driven by the drive member A to transfer drive torque to the cam shaft. Namely, the driven member B is rotated relative to drive member A, by the workings described below, to shift the cam shaft into the advancing side or the delaying side.

Drive member A is composed of a timing pulley 1, with a generally cylindrical shape, driven by a timing belt, a shoe housing 2, and rear plate 3 incorporated in the timing pulley 1. The drive member A can be rotated in synchronization with a rotary motion of the crank shaft. Also, the timing pulley 1, the shoe housing 2, and the rear plate 3 are fastened to each other with a plurality of bolts 4. Furthermore, as shown in FIG. 2, the drive member A can be rotated by the timing belt in a clockwise direction. In this embodiment, such a clockwise direction is regarded as an advancing direction. Also, as shown in FIG. 3, two or more generally fan-shaped pressure chambers 5 (four chambers in the present embodiment) are formed in the shoe housing 2.

The driven member B includes a vane rotor 7 strongly fastened to the cam shaft with bolts 6. The vane rotor 7 has two or more vanes 8 extending radially from the outer periphery of the vane rotor 7. In this embodiment, but not limited to this embodiment, there are four vanes 8 as shown. The vanes 8 are disposed in the single fan-shaped pressure chambers 5 (one vane per chamber) formed between the adjacent projecting portions of the shoe housing 2 and divide each of the respective chambers 5 into an advancing chamber 5*a* and a delaying chamber 5*b*. The vane rotor 7 is implemented in the shoe housing 2 so as to be turned at an angle within a predetermined range with respect to the shoe housing 2. The advancing chamber 5*a* and the delaying chamber 5*b* are provided as hydraulic chambers enclosed with the shoe housing 2, the rear plate 3, and the vane rotor 7. In addition, each of these chambers 5*a*, 5*b* is kept fluid-tight by a seal member 9 or the E like placed on a groove formed on the tip of the vane 8. In other words, the advancing chamber 5*a* is a hydraulic chamber for driving the vane 8 with an oil pressure in the advancing direction, but formed in a section of the chamber in a counter-rotational direction relative to the vane 8. The delaying chamber 5*b* is a hydraulic chamber for driving the vane 8 with an oil pressure in the delaying direction, but formed in the clockwise direction relative to the vanes 8.

A hydraulic difference generating means (not shown) is mounted on the valve timing control device to supply a fluid such as oil to both the advancing chamber 5*a* and the delaying chamber 5*b* and also drains the fluid out of the chambers 5*a*, 5*b*. In other words, such hydraulic difference generating means is provided as a means for generating the difference between the oil pressure in the advancing chamber 5*a* and the oil pressure in the delaying chamber 5*b* to allow the relative rotation of the vane rotor 7 against the shoe housing 2.

Such means may be one comprising an oil pump to be driven by a crank shaft, one or more switching valves for switching passages of oil to be pumped by the oil pump to the advancing chamber 5*a* and the delaying chamber 5*b*, an electromagnetic actuator for driving the switching valve, and a controller for controlling the electromagnetic actuator. In addition, the controller controls an electromagnetic actuator in response to the driving conditions of the engine, such as crank angle, engine speed, and throttle opening, which can be detected by various kinds of sensors and allows the generation of an oil pressure for actuating the engine in response to the driving conditions of the engine in each of the advancing chamber 5*a* and the delaying chamber 5*b*.

A locking pin 11 (FIG. 3) is mounted in one of the vanes 8 to fix the turning position of the vane rotor 7 to a predetermined advancing position (e.g., the most advanced position) at the startup of the engine. The locking pin 11 is inserted into a generally cylindrical-shaped guide ring 12 that is press-inserted into the vane 8 and is urged toward the front side by a compression spring 13. Then, the vane rotor 7 can be fixed on the shoe housing 2 in the state in which the head portion of the locking pin 11 is fitted in a fitting hole 14 formed in the shoe housing 2.

A step portion 11*a* is formed as a recess at the middle of the locking pin 11 for moving the locking pin 11 toward the rear side (in the direction of disengagement) by an oil pressure. Also, the step portion 11*a* communicates with the advancing chamber 5*a*. Thus, the locking pin 11 can be removed from the fitting hole 14 against the spring force of the compression spring 13 by a hydraulic pressure when the hydraulic oil of a predetermined pressure or more is supplied to the advancing chamber 5*a*.

In addition, the front end surface of the locking pin 11 communicates with the delaying chamber 5*b*. Thus, the locking pin 11 can be removed from the fitting hole 14 against the spring tension of the compression spring 13 by a hydraulic pressure when the hydraulic oil of a predetermined pressure or more is supplied to the delaying chamber 5*b*.

A torsion spring 15 is mounted on the valve timing control device to urge the driven member B relative to the drive member A toward the advancing side. A first end of the torsion spring 15 is engaged with the shoe housing 2 or a member rotatable with the shoe housing 2, and a second end is engaged with the vane rotor 7 or a member rotatable with the vane rotor 7. In this embodiment, one end of the torsion spring 15 is engaged with a spring-engaging pin 16 that is press-inserted and fixed in the front surface of the shoe housing 2, and the other end is engaged with a washer 17 press-inserted and fixed in the vane rotor 7.

The washer 17 receives the fastening-torque of a bolt 6 used for fastening the vane rotor 7 to the cam shaft while holding the torsion spring 15 to prevent the interference between the torsion spring 15 and the vane rotor 7. In addition, since the bolt 6 fits through the washer 17, which may be made of a hard metal such as iron or stainless steel, wear or deformation of the vane rotor 7 by the bolt 6 is prevented since the vane rotor 7 may be made of aluminum or a soft iron.

The engagement between the end of the torsion spring 15 and the vane rotor 7 will now be described. The inward end 18 of the torsion spring 15 to be engaged with the washer 17 (a member rotatable with the vane rotor 7) is formed so as to be directed in the radial direction toward the center of the torsion spring 15 as shown in FIG. 1 and FIG. 2.

In addition, the washer 17 has a hook groove 19 for engaging the inward end 18 of the torsion spring 15. The hook groove 19 is formed on a bushing 17*a* of the washer 17 beneath the bearing surface of the bolt 6 (on the right side of FIG. 1). As shown in FIG. 2, the hook groove 19 is formed in the radial direction toward the center of the torsion spring 15.

In the valve timing control device of the first embodiment, therefore, the end of the torsion spring 15 to be engaged with the vane rotor 7 is formed in the radial direction toward the center of the torsion spring and the hook groove 19 to engage that end is also formed inwardly in the radial direction of the torsion spring 15.

Therefore, the inward end 18 and the hook groove 19 are formed in the radial direction (perpendicular to the axial direction) of the torsion spring 15, so that there is no need to form a hole for engaging the torsion spring on the vane rotor (or the member rotatable with the van rotor) in the axial direction thereof as is the case of the prior art technology. As a result, it becomes possible to prevent the vane rotor side of the shoe housing from necessarily having a larger cross-section or being thick.

Also, the hook groove 19 is formed inwardly in the radial direction of the torsion spring 15, so that the hook groove 19 cannot be formed in the inside of the vane 8. Therefore, the strength of the vane 8 will not be compromised. In addition, such a configuration of the hook groove 19 allows the size of the vane rotor 7 to be decreased when compared to traditional configurations. Furthermore, the hook groove 19 is not formed in the inside of the vane 8, therefore the sealing length of the vane 8 does not become shortened, so that an appropriate sealing between the advancing chamber 5*a* and the delaying chamber 5*b* can be attained.

In the valve timing control device of the first embodiment, as described above, the hook groove 19 for engaging with the torsion spring 15 is formed on the bushing 17*a* beneath the bearing surface of the bolt 6, so that the torsion spring 15 is brought into contact with the washer 17 made of a material with a high hardness. Therefore, wear of the vane rotor 7 in contact with the torsion spring 15 can be avoided even though the vane rotor 7 is made of a material with a comparatively low hardness, such as aluminum or soft iron.

[Second Embodiment]

Figure 4:
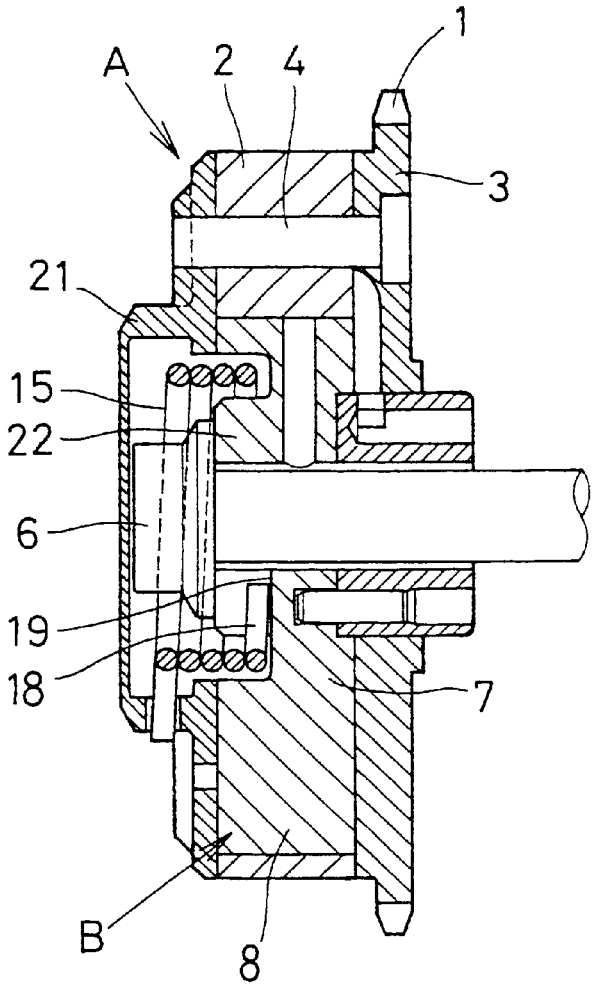
FIG. 4 is a cross-sectional view taken along the axial direction of a valve timing control device in a second embodiment of the present invention.
Figure 5:
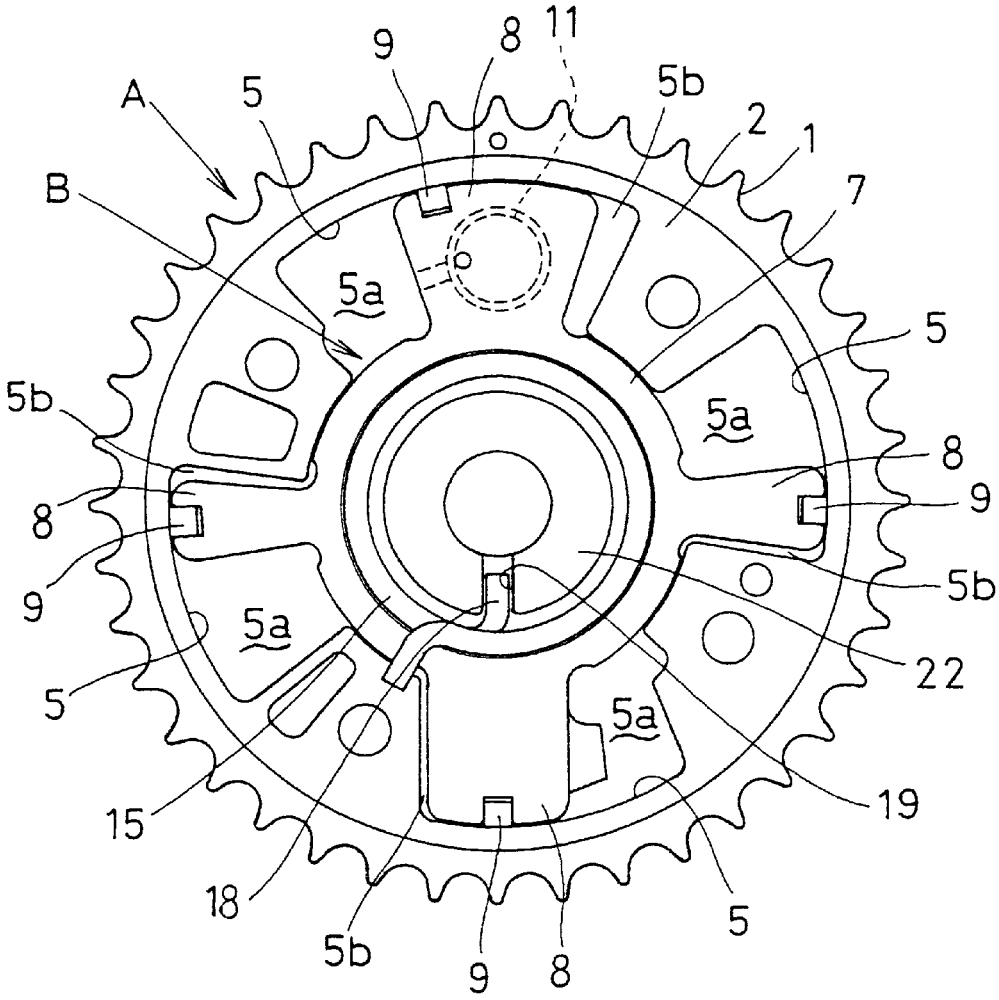
FIG. 5 is a front view of the valve timing control device of the second embodiment, in which a front plate is removed.

A valve timing control device as a second embodiment of the present invention is shown in FIGS. 4 and 5. FIG. 4 is a cross-sectional view taken along an axial direction of the valve timing control device for illustrating the configuration of the valve timing control device. FIG. 5 is a front view of the valve timing control device in the state that a front plate is removed. Hereinafter, in the second and subsequent embodiments, the same reference numerals as those of the first embodiment refer to similar components as those of the first embodiment.

In the valve timing control device described in the first embodiment, the front side of the chamber 5 is closed by the shoe housing 2 itself. In the second embodiment, on the other hand, the front side of the chamber 5 is closed by a front plate 21 which is in the shape of a disk. In the first embodiment, furthermore, the shoe housing side of the torsion spring 15 is engaged with the shoe housing 2 through the spring-engaging pin 16. In the second embodiment, on the other hand, the shoe housing side of the torsion spring 15 is engaged with the shoe housing 2 through the front plate 21. Furthermore, in the second embodiment, the function of the timing pulley 1 of the first embodiment is implemented in the rear plate 3.

In the above first embodiment, the washer 17 is placed between the bolt 6 and the torsion spring 15 because the vane rotor 7 is made of a comparatively soft material such as aluminum or soft iron. In the second embodiment, on the other hand, the vane rotor 7 is made of a high hardness material such as normal iron, for example, and thereby the washer can be eliminated. In the second embodiment, therefore, the hook groove 19 is directly formed in the vane rotor 7. That is, the hook groove 19 of the second embodiment is formed on a front protruded portion 22 of the vane rotor 7 beneath the bearing surface of the bolt 6.

In the second embodiment, just as in the case with the first embodiment, the end portion of the torsion spring 15 is formed in the radial direction toward the center of the coiled portion. Also, the hook groove 19 for engaging the torsion spring 15 is formed in the radial direction toward the center of the coiled portion. Just as with the first embodiment, it becomes possible to use a thinner driven member B, that is, a driven member B with a smaller cross-section, in the axial direction thereof without forming the hook groove 19 in the vane 8. Therefore, the strength of the vane 8 is not compromised. In addition, sealing between the advancing chamber 5*a* and the delaying chamber 5*b* with the vain 8 is achieved.

[Third Embodiment]

Figure 6:
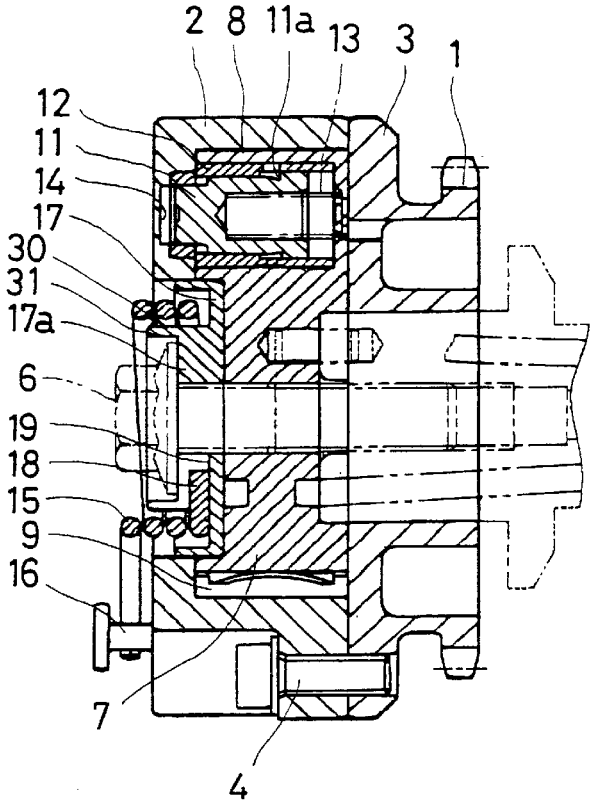
FIG. 6 is a cross-sectional view taken along the axial direction of a valve timing control device in a third embodiment of the present invention.
Figure 7:
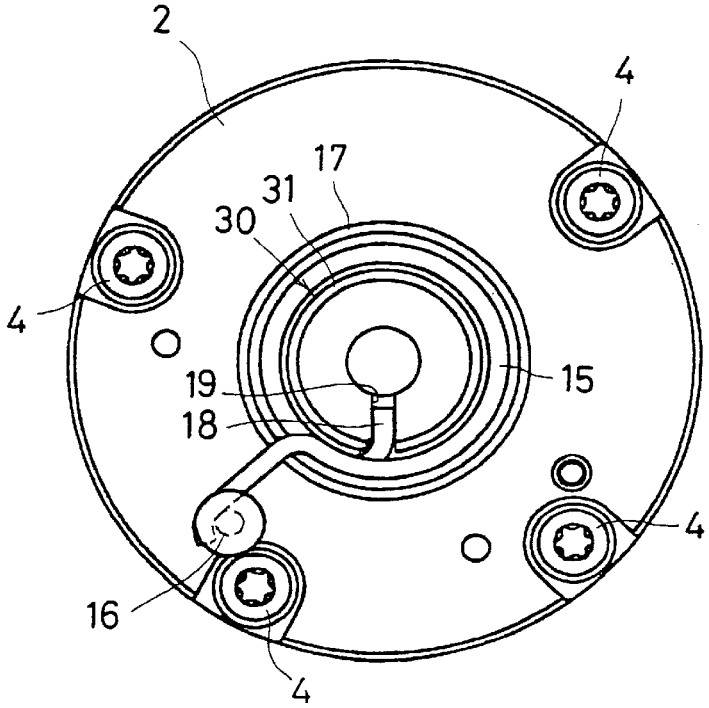
FIG. 7 is a front view of the valve timing control device of the third embodiment, in which a bolt is removed.

Referring now to FIG. 6 and FIG. 7, a valve timing control device in a third embodiment of the present invention will be described. In these figures, FIG. 6 is a sectional view taken along an axial direction of the valve timing control device for illustrating the configuration of the valve timing control device. FIG. 7 is a front view of the valve timing control device showing the absence of a bolt 6.

In the third and further embodiments, the periphery of a coil-supporting member 30 is enclosed in a coiled portion of the torsion spring 15. The coil-supporting member 30 is mounted on the shoe housing 2 (or a member rotatable with the shoe housing 2) or the vane rotor 7 (or a member rotatable with the vane roller 7) and is responsible for preventing the coiled portion from becoming eccentric or inclined.

The coil-supporting member 30 of the present embodiment is integrally formed with the hard washer 17 described in the first embodiment. As shown in FIG. 6, the coil-supporting member 30 comprises the bushing 17*a* formed on the bearing surface of the bolt 6 and the inner peripheral wall 31 extending from the bushing 17*a* to the front.

The outer peripheral wall of the coil-supporting member 30 (the bushing 17*a* and the inner peripheral wall 31) is in the shape of a cylinder. In addition, the outer diameter of the coil-supporting member 30 is substantially the same as the inner diameter of the coiled portion of the torsion spring 15. Therefore, the coil-supporting member 30 restricts the shape or position of the coiled portion of the torsion spring within a predetermined range by being arranged on the inside and outside of the coiled portion to prevent the coiled portion from becoming eccentric, skewed, or inclined.

The valve timing control device of the present embodiment is constructed as described above, so that the position of the torsion spring 15 can be kept in place even though the spring load applied on the torsion spring 15 changes as the vane rotor 7 is displaced to the advancing side or the delaying side. In this case, furthermore, the coiled portion of the torsion spring will not become inclined, skewed, or eccentric from the axial center of the coiled spring because the torsion spring 15 will maintain its designed, appropriate position even during a changing load. Consequently, the torsion spring 15 is permitted to constantly generate the predetermined amount of torque irrespective of the presence or absence of the variations in spring load upon the torsion spring 15. Additionally, because the torsion spring 15 maintains its position, wearing of adjacent or other parts by the torsion spring 15 making contacting with the other parts (for example, shoe housing 2, a front plate (not shown), and the like) does not occur.

[Fourth Embodiment]

Figure 8:
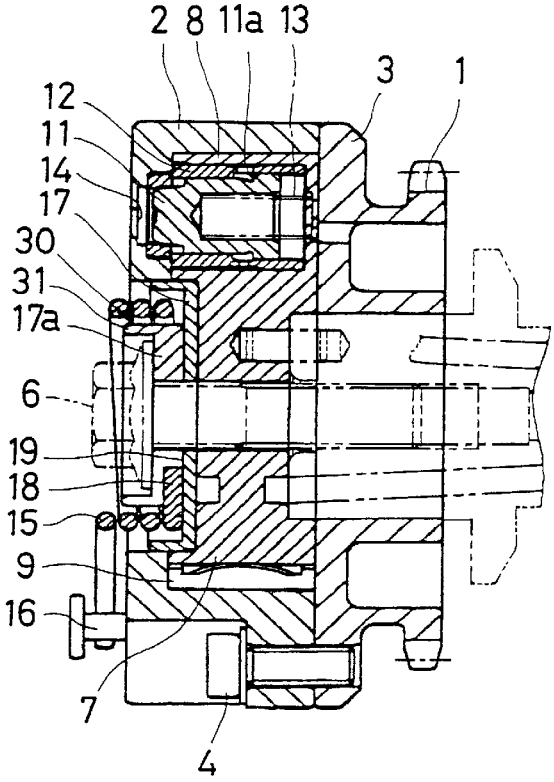
FIG. 8 is a cross-sectional view taken along the axial direction of a valve timing control device in a fourth embodiment of the present invention.
Figure 9:
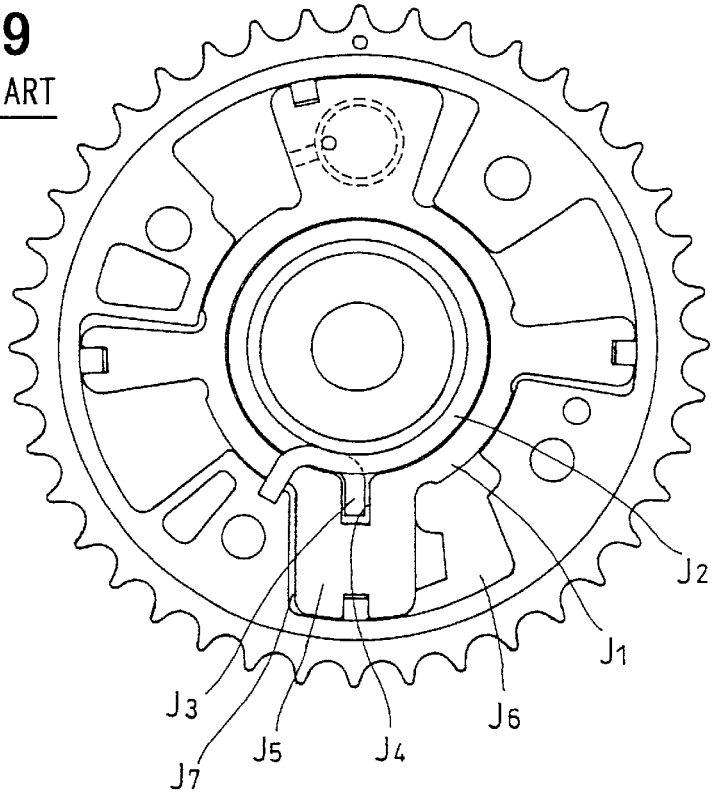
FIG. 9 RELATED ART
FIG. 9 is a related art, front view of a valve timing control device, in which a front plate is removed.

Referring now to FIG. 8, a valve timing control device of a fourth embodiment of the present invention will be described. FIG. 8 is a cross-sectional view taken along an axial direction of the valve timing control device for illustrating the internal configuration of the valve timing control device. In this embodiment, the coil-supporting member 30 (i.e., the bushing 17*a* and the inner peripheral wall 31) and the washer 17 are separate pieces for the following reasons.

The above third embodiment exemplifies that the coil-supporting member 30 (the bush 17*a* and the inner peripheral wall 31) is integrally formed with the washer 17 to be fixed on (or engaged with) the vane rotor 7. If such a member (i.e., the coil-supporting member 30 and the washer 17) is prepared using a sintered material, it is preferable to sinter the thinned portion of the inner peripheral wall 31 or the like without post processing. If it is difficult to form the thinned portion using the sintering process, the thinned portion must be subjected to post processing. In other words, the thinned portion may be post-processed by performing a cutting operation on a sintered thick-wall material when there is difficulty in forming the thinned portion by sintering. In this case, however, the cost of manufacturing the part rises. Alternatively, if the above member (i.e., the coil-supporting member 30 and the washer 17) is prepared using a press, the thickness of the resulting member increases. In this case, it becomes much more difficult to process the coil-supporting member 30. Furthermore, the cost increases if the coil-supporting member 30 (i.e., the coil-supporting member 30 and the washer 17) is prepared by cutting a solid metal.

In the case the above problems present themselves, the fourth embodiment solves the problems since the coil-supporting member 30 (i.e., the bush 17*a* and the inner peripheral wall 31) and the washer 17 are independent pieces that are manufactured separately of each other which simplifies their shapes. Therefore, the costs for forming the coil support can be minimized. Furthermore, the same effects as those of the third embodiment can be obtained.

[Fifth Embodiment]

In a fifth embodiment, but not shown in a figure, a valve timing control device comprises the same configuration as that of the third or fourth embodiment, except the coil-supporting member 30 is directly formed on a vane rotor 7.

In the above third and fourth embodiments, the vane rotor 7 is prepared using a comparatively soft material such as aluminum or soft iron and thus the washer 17 is placed between the rotor 7, and the bolt 6 and the torsion spring 15. To the contrary, as in the case with the second embodiment, the vane rotor 7 of the fifth embodiment is formed using a high-hardness material such as iron, so that the washer 17 can be eliminated and so that the coil-supporting member 30 can be directly formed on the vane rotor 7. Furthermore, the coil-supporting member 30 of this embodiment comprises a front protruding portion 22 formed around the bearing surface of the bolt 6 and an inner peripheral wall 31 extending from the front protruded portion 22. Consequently, the same advantages as those of the third embodiment can also be attained in the fifth embodiment.

[Modified Embodiments]

In each of the above-described embodiments, the valve timing control device has four chambers 5 in the shoe housing 2 and four vanes 8 radially extending from the outer periphery of the vane rotor 7. According to embodiments of the present invention, however, the configuration of the valve timing control device is not limited to those disclosed in the above embodiments. The number of chambers 5 and vanes 8 may be one or more, so that the device having a different number of chambers 5 or vanes 8 can be manufactured. For instance, three chambers 5 may be formed on the shoe housing 2 and three vanes 8 may be formed on the periphery of the vane rotor 7, or alternatively two chambers 5 may be formed on the shoe housing 2 and two vanes 8 may be formed on the periphery of the vane rotor 7.

In each of the above embodiments, the present invention is applied on the valve timing control device to be mounted on the cam shaft on the exhaust side of an engine. According to embodiments of the present invention, it is also permissible to apply the embodiments to the valve timing control device mounted on the cam shaft on the inlet side of an engine.

Furthermore, in each of the above embodiments, the vane rotor 7 is fixed on the end surface of the cam shaft. According to the present invention, however, the cam shaft may be arranged such that it extends through the center of the vane rotor 7. Continuing with each of the above embodiments, the exemplified device includes the locking pin 11 which is axially movable to fit into the fitting hole 14. According to the present invention, however, the embodiments are not limited to such a configuration. The locking pin 11 may be radially moved to fit into the fitting hole 14. In this case, the fitting hole 14 can be formed on the inner peripheral wall of the shoe housing 2. In addition, the locking pin 11 may be accommodated in the shoe housing 2, while the fitting hole 14 may be formed on the vane rotor 7.

In each of the above embodiments, the shoe housing 2 is rotated together with the crank shaft (drive shaft), while the vane rotor 7 is rotated together with the cam shaft (driven shaft). According to embodiments of the present invention, however, it is not limited to such a configuration. The vane rotor 7 may be rotated together with the crank shaft (drive shaft), while the shoe housing 2 may be driven together with the cam shaft (driven shaft). Furthermore, in each of the above embodiments, the torsion spring 15 is arranged on the front side (opposite to the cam shaft side) of the vane rotor 7. However, the embodiments are not limited to such a configuration. The torsion spring 15 may be arranged on the rear side (the cam shaft side) of the vane rotor 7.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A valve timing control device mounted on a power transmission system for transferring power from a drive shaft of an internal combustion engine to a driven shaft for opening and closing a valve, and provided for causing a phase difference between the rotation of the drive shaft and the rotation of the driven shaft, comprising:

a shoe housing having a chamber, the shoe housing being rotatable together with one of the drive shaft and the driven shaft;

a vane rotor having a vane, the vane rotor being rotatable together with the other of the drive shaft and the driven shaft, the vane partitioning the chamber formed in the shoe housing into an advancing chamber and delaying chamber, the vane rotor being fastened to the driven shaft using a bolt; and a torsion spring having a first end engaged with the shoe housing or a member rotatable together with the shoe housing and a second end engaged with the vane rotor or a member rotatable together with the vane rotor to urge the vane rotor relative to the shoe housing toward an advancing side or a delaying side, wherein the second end of the torsion spring engaged with the vane rotor or the member rotatable together with the vane rotor is directed toward a center of the torsion spring along the radial path of the torsion spring, and wherein the vane rotor or the member rotatable together with the vane rotor has a hook groove with which the second end of the torsion spring is engageable said hook groove being defined on the vane rotor side of a bearing surface of the bolt in the axial direction so that second end of the torsion spring is disposed beneath the bearing surface of the bolt in the axial direction.

2. The valve timing control device as claimed in claim 1, wherein the bolt includes a head portion defining said bearing surface and wherein said bearing surface is generally planar.

3. The valve timing control device as claimed in claim 1, wherein the vane rotor includes a bushing defining a hole, said bolt passing through the hole of the bushing, and wherein an outer diameter of said bushing generally corresponds to an outer diameter of said bearing surface.

4. The valve timing control device as claimed in claim 1, wherein said hook groove is formed in the radial direction toward the center of the torsion spring.

5. The valve timing control device as claimed in claim 1, wherein the vane rotor includes a washer defining a hole and used for fastening the vane rotor using said bolt which passes through said hole, and wherein said washer is formed from iron or stainless steel.

6. A valve timing control device as in claim 1, wherein the vane rotor includes a bushing defining a hole, said bolt passing through the hole of the bushing, and wherein said hook groove opens through a radially outer surface of said bushing.

7. A valve timing control device as in claim 1, wherein the vane rotor includes a bushing defining a hole, said bolt passing through the hole of the bushing, and wherein said hook groove opens through a surface of said bushing facing said bearing surface of said bolt.

* * * * *